United States Patent [19]

Rogers

[11] 4,052,008

[45] Oct. 4, 1977

[54] BLOW GUN

[75] Inventor: Gerald Lee Rogers, St. Louis, Mo.

[73] Assignee: Chemetron Corporation, Chicago, Ill.

[21] Appl. No.: 676,105

[22] Filed: Apr. 12, 1976

[51] Int. Cl.[2] ..... B05B 1/00

[52] U.S. Cl. ..... 239/526; 239/570; 239/586; 239/DIG. 22

[58] Field of Search ..... 239/526, 570, 572, 586; 141/210, 214, 215, 217, 206; 137/495

[56] References Cited

U.S. PATENT DOCUMENTS

| | | | |
|---|---|---|---|
| 2,111,851 | 3/1938 | Flinchbaugh | 141/215 |
| 2,604,361 | 7/1952 | Yates | 239/572 X |
| 3,276,486 | 10/1966 | Slattery | 141/215 X |
| 3,612,406 | 10/1971 | Bass, Jr. | 239/526 |

*Primary Examiner*—John J. Love
*Attorney, Agent, or Firm*—N. M. Esser

[57] ABSTRACT

A manually operated blow gun for cleaning work pieces by use of compressed air which includes a back pressure sensitive control that is effective when the gun is dead ended with the trigger depressed. The gun has a trigger operated valve which causes actuation of a main output valve, wherein when back pressure is increased, the pressure is directed via a by-pass conduit to close the main output valve against the action of the trigger operated valve.

9 Claims, 4 Drawing Figures

BLOW GUN

BACKGROUND OF THE INVENTION

1. Field of the Invention

This invention pertains to blow guns for cleaning work pieces.

2. Description of the Prior Art

A conventional, manually operated, blow gun may have a handle with an inlet adapted to be connected to a source of compressed air and an outlet which may include a nozzle. Frequently associated with the nozzle are aspirating devices wherein outside air is combined with source air for economical flow. Also included may be nozzle structure to produce an air cone to protect the blow gun operator from flying chips or particles. The control for the blow guns is usually a trigger operated, poppet valve which connects the nozzle to the air inlet when the trigger is depressed and disconnects same, via biasing means, when the trigger is released.

Recent U.S. Government (O.S.H.A.) safety standards specify that compressed air cannot be used for cleaning purposes except when reduced to 30 p.s.i. or less, and then only with effective chip guarding. The above standard has also been interpreted by the O.S.H.A. Administration to permit use of a nozzle for cleaning operations which includes a pressure reducer or a device which will reduce air pressure to 30 p.s.i. or less if the nozzle is dead ended.

To meet the above standard, most manufacturers have merely built in either pressure reducers or regulators which only allow 30 p.s.i. at the nozzle continuously. Inasmuch as the usual pressure available at the nozzle has been 100 p.s.i., the air pressure available for cleaning is severely reduced and the effectiveness of the blow gun is diminished.

SUMMARY OF THE INVENTION

Applicant has designed a blow gun that will meet O.S.H.A. safety standards and still provide the normal 100 p.s.i. for cleaning at the work station. Specifically, Applicant has provided a blow gun that meets the interpretation of the O.S.H.A. standard at 30 p.s.i. or less air pressure if the nozzle is dead ended, by a double valve, back pressure controlled gun. Applicant has retained the trigger operated valve of the prior art but has converted same to act essentially as a pilot valve. Applicant has added a second valve, which is preferably a spool valve, in communication with the pilot valve for controlling the outlet air flow to the nozzle. The pilot valve controls the location of the second valve in response to trigger position under normal conditions. Applicant has also added an internal bypass conduit from the outlet to the what may be denominated the piston end of the second valve opposite the end in communication with the first valve. In the event of dead ending (nozzle blockage), the ensuing back pressure is applied to this end of the second valve with its larger effective area and same is moved to the closed or off position against air moving from the pilot valve (since the trigger is depressed) against the smaller effective area of the other end of the second valve which is in communication with the pilot valve. Biasing means may also be used to assist movement of the second valve to the closed position where same essentially floats between the columns of air. It is to be noted that the air pressure in the outlet line and the bypass line is static because of no flow.

Only the small amount of air trapped therein is available (which is virtually equivalent to zero pressure) should the nozzle become cleared, unlike the prior art 30 p.s.i. air and unlimited volume immediately available on a cleared nozzle condition. Until the bypass and outlet line have cleared, only then, can the air moving through the pilot valve move the second valve to the open position and provide full 100 p.s.i. air at the nozzle. Hence, Applicant's device exceeds the safety standard while still allowing its normal 100 p.s.i. output cleaning pressure after the safety delay noted.

It is therefore, an object of this invention to provide a new and improved blow gun.

Another object of this invention is to provide a flow gun that has a neck pressure control that is automatically effective when the blow gun is dead ended.

DESCRIPTION OF THE PREFERRED EMBODIMENT

Figure 1:
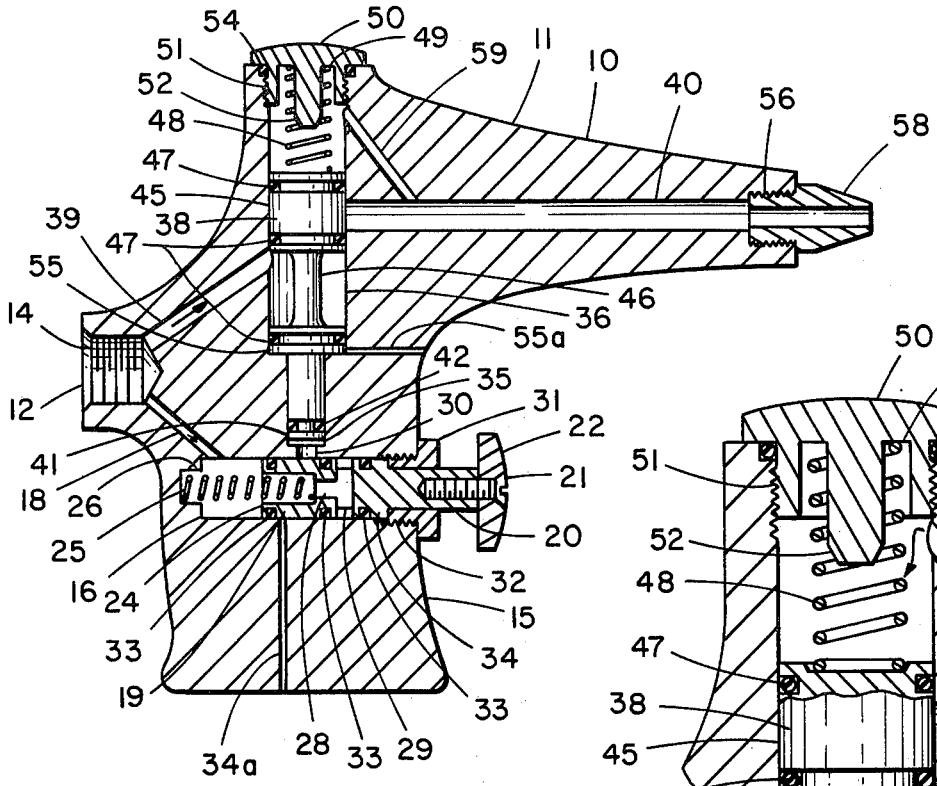
FIG. 1 is a sectional elevational view of the blow gun with the valves in the closed position and no air moving through the gun.
Figure 4:
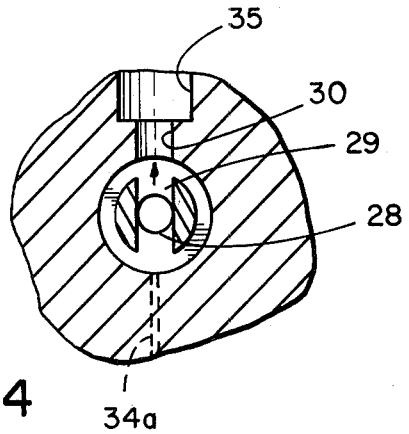
FIG. 4 is a sectional view taken along line 4—4 of FIG. 2.

Referring to FIG. 1, 10 indicates, generally, the blow gun of this invention. Gun 10 includes housing 11. Housing 11 has a fluid inlet 12 which is equipped with a suitable internal thread 14 for connection, preferably via a flexible hose, to a source of suitable fluid which is preferably compressed air. Located in housing 11, which has a portion serving as a handle 15, is cylindrical chamber 16. Chamber 16 is connected by passage 18 to air inlet 12. Positioned for movement in chamber 16 is valve member 19 which thereby provides a poppet type valve. Member 19 has an elongated neck portion 20 which extends from chamber 16 outside of handle 15 of housing 11. Connected to the end of neck portion 20 by a capscrew 21 is trigger 22. Member 19 also has a recess 24 in the end opposite the neck portion in which is located spring 25. Spring 25 extends between recess 24 and cavity 26 in housing 11. Recess 24 has an opening 28 extending therefrom generally longitudinally of member 19 into a radially extending conduit 29 (see FIG. 4) that is alignable with passage 30 extending from chamber 16. Combination plug and slideway 31 is mounted in chamber 16 adjacent trigger 22 by means of internal thread 32. Suitable members, such as "O" rings 33, mounted in annular recesses in member 19 seal same in its various positions shown in FIGS. 1 and 2.

Figure 2:
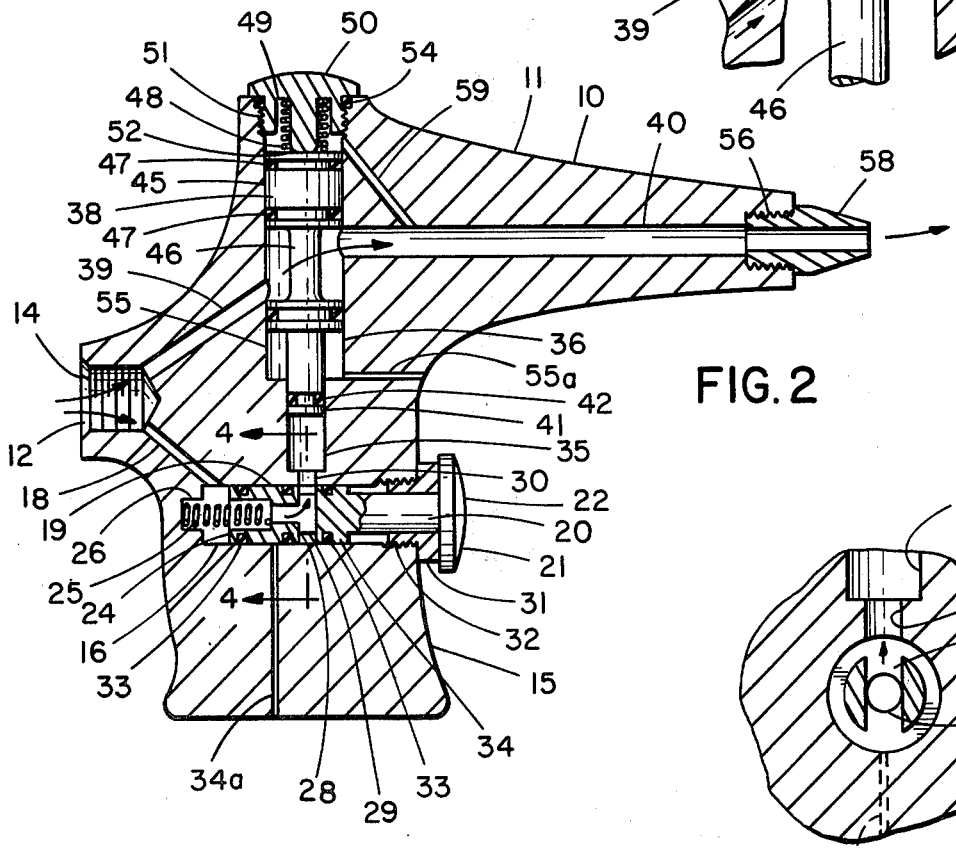
FIG. 2 is a view similar to FIG. 1 with the valves in the open position and the air flow as noted by the arrows.

Spring 25 extending between cavity 26 and recess 24 of member 19, normally biases member 19 and trigger 22 outwardly of chamber 16 to the trigger extended position. In this position, radial conduit 29 (see FIG. 1) is not aligned with passage 30 and air cannot enter same. Shoulder 34 of member 19 provides a stop in conjunction with slideway 31 in the trigger extended position. Slideway 31 also provides a stop for trigger 22 when same is depressed and radial conduit 29 of member 19 is then aligned with passage 30 for the movement of air therethrough from inlet 12 via passage 18 as shown in FIG. 2. Bleed passage 34*a* extending from chamber 26 to the base of handle 15 relieves pressure depending upon the position of member 19.

Referring to FIG. 1, connected to passage 30 is bore inlet 35. Inlet 35 forms an extension of bore 36 in which is movably mounted second valve member 38. Bore 36 is connected by passage 39 to inlet 12 and also is connected to outlet 40. Member 18 controls the flow of air from inlet 12 to outlet 40. Member 38 has a first portion 41 that is located in inlet 35. "O" ring 42 seals portion 41 in inlet 35. Member 38 also has a second portion 45 located in bore 36 which has a larger end diameter than portion 41. Portion 45 is also designed to block flow of air to outlet 41. A reduced portion 46 of member 38 allows air flow to outlet 40 as shown in FIG. 2. "O" rings 47 seal member 38 in bore 36. Spring 48 extends between a recess at one end of member 38 and annular seat 49 in plug 50. Plug 50 is adapted to engage an internal thread 51 in and end of bore 36 to close same and has an abutment 52 which serves as a stop for member 38. "O" ring 54 seals plug 50. Wall 55 of bore 36 serves as a stop for member 38 when same is in a position opposite abutment 52. Bleed passage 55*a* may be provided to relieve pressure in bore 36.

Threaded into internal thread 56 in outlet 40 is nozzle 58. Nozzle 58 may have a suitable restriction from that of outlet 40 to increase the velocity of air moving therethrough. Bypass conduit 59 extends from outlet 40 to bore 36 adjacent plug 50 to provide communication for the air in outlet 40 with member 38 where same is contacted by spring 48.

In operation, with the gun 10 as shown in FIG. 1 connected to a source of compressed air, no air moves through the gun as portion 45 of member 38 blocks movement of air from passage 39 to outlet 40. Also, with the trigger 22 extended, no air can move through passage 18, chamber 16 and into passage 30 as radial conduit 29 is not aligned therewith. When trigger 22 is depressed until it contacts plug 31 (see FIG. 2) and member 19 is therefore moved against spring 25, radial conduit 29 becomes aligned with passage 30. Air, therefore, can move from passage 18 through chamber 16 and into bore inlet 35 where same contacts first portion 41 of member 38. Member 38 is then moved upwardly against spring 48 until contact with abutment 52 is made which then aligns reduced portion 46 of member 38 for flow between passage 39 and outlet 40. Full air pressure available from the source, which may be 100 p.s.i., is then also available at nozzle 58. If the trigger 22 is released, spring 25 biases member 19 and trigger 22 to be extended position of FIG. 1. Air tripped beneath first portion 41 of member 38 then moves through chamber 16 and out bleed passage 34*a* allowing spring 48 to move member 38 and portion 45 into blocking position to prevent air flow from passage 39 to outlet 40. Bleed passsge 55*a* also will release any pressure trapped in bore 36.

Figure 3:
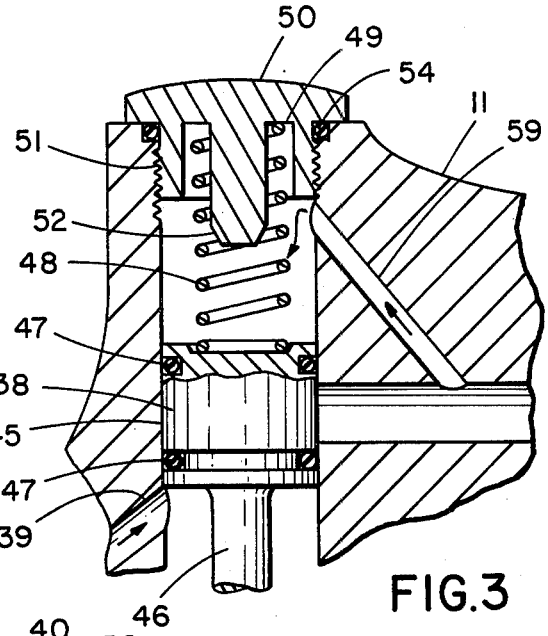
FIG. 3 is an enlarged, sectional view of a portion of the second valve showing same in the closed position when the gun is dead ended (nozzle blocked) and the trigger depressed as in FIG. 2.

Should nozzle 58 become blocked during usage with the trigger 22 depressed and air moving through the gun, the resulting back pressure will cause air flow from outlet 40 through bypass conduit 59 against the end portion 45 of member 38. Since this effective area is larger than that of portion 41 and the pressure available is substantially the same, member 38 will move to the closed or off position wherein portion 45 cuts off flow between passage 39 and outlet 40. Member 38 is therefore balanced on columns of air from above and below as shown in FIG. 3. Spring 48 assists in maintaining this position.

It is to be noted that with the nozzle blocked that the pressure in outlet 40, conduit 59 and the adjacent end of bore 36 is static pressure with only a small volume of air involved. Thus in this position, the nozzle essentially has a zero equivalent pressure as very little air is immediately available should the blockage be removed as compared with the 30 p.s.i. pressure and unlimited volume available in the prior art designs which however, meet the Government safety standard. A delay is, therefore, present until member 38 has again moved to the position where portion 46 allows flow between passage 39 and outlet 40 and thus, the operator is better prepared to cope with the sudden emergency of a large volume of air. Applicant's device, therefore, provides improved safety, exceeding Government standards, while allowing the utilization of 100 p.s.i. air for normal cleaning purposes.

I claim:

1. A blow gun comprising:

a. a housing having an inlet adapted to be connected to a source of fluid and a fluid outlet, said housing also having a handle adapted to be grasped by an operator;

b. a trigger movably mounted on said handle;

c. a first valve member movably mounted in said housing for movement by said trigger, said first member being in communication with said inlet;

d. a second valve member movably mounted in said housing, said second member being a spool valve and in communication with said inlet and outlet, said second member having a first portion in communication with said first member, and a second portion for shutting off flow to said outlet and having a larger effective area than said first portion;

e. means for biasing said second member toward a position to shut off flow to said outlet; and f. a bypass conduit in communication with said outlet and said second portion, said bypass conduit, upon blockage of said outlet, providing access for the fluid to said second portion to move said second member to shutt off flow to said outlet when said trigger is depressed and said first member is open to the fluid for delivery to said first portion of said second member.

2. The blow gun of claim 1 further comprising: means for biasing said first member and said trigger to an extended position.

3. The blow gun of claim 2 further comprising: means located in said housing adjacent said first member for relieving pressure when said first member and said trigger have moved to an extended position.

4. The blow gun of claim 3 further comprising: means for relieving pressure located in said housing adjacent said second member for relieving pressure when said second member has moved to an off position.

5. The blow gun of claim 4 in which said bypass circuit is located in said housing.

6. The blow gun of claim 5 further comprising: nozzle means mounted in said outlet.

7. The blow gun of claim 6 in which said first member is of the poppet valve type.

8. The blow gun of claim 7 further comprising: stop means for establishing the position of said second member in the open position for fluid flow between sid inlet and outlet.

9. The blow gun of claim 8 further comprising: sealing means for said first and second members, said sealing means establishing flow paths for said pressure relieving means depending upon the position of said first and second members.

* * * * *

UNITED STATES PATENT AND TRADEMARK OFFICE

CERTIFICATE OF CORRECTION

PATENT NO. : 4,052,008

DATED : October 4, 1977

INVENTOR(S) : Gerald Lee Rogers

It is certified that error appears in the above-identified patent and that said Letters Patent are hereby corrected as shown below:

Col. 1, line 44, delete "at" and insert -- of --.
Col. 2, line 14, delete "flow" and insert -- blow --;
Col. 2, line 15, delete "neck" and insert -- back --.
Col. 3, line 9, delete "18" and insert -- 38 --;
Col. 3, line 20, after "in" delete "and" and insert -- an --;
Col. 3, line 29, delete "to" and insert -- into --;
Col. 3, line 51, delete "be" and insert -- the --;
Col. 3, line 52, delete "tripped" and insert -- trapped --;
Col. 3, line 57, delete "passge" and insert -- passage --.

Claims

Col. 4, lines 56 & 57, delete "circuit" and insert -- conduit --;
Col. 4, line 60, delete "sid" and insert -- said --.

Signed and Sealed this

*Seventeenth* Day of *January 1978*

[SEAL]

*Attest:*

RUTH C. MASON
*Attesting Officer*

LUTRELLE F. PARKER
*Acting Commissioner of Patents and Trademarks*